US012467715B2

(12) United States Patent
Slankamenac

(10) Patent No.: US 12,467,715 B2
(45) Date of Patent: Nov. 11, 2025

(54) HUNTING VEST SYSTEM

(71) Applicant: Milan Slankamenac, Morahalom (HU)

(72) Inventor: Milan Slankamenac, Morahalom (HU)

( * ) Notice: Subject to any disclaimer, the term of this patent is extended or adjusted under 35 U.S.C. 154(b) by 0 days.

(21) Appl. No.: 18/692,953

(22) PCT Filed: Aug. 24, 2022

(86) PCT No.: PCT/IB2022/057929

§ 371 (c)(1),
(2) Date: Mar. 18, 2024

(87) PCT Pub. No.: WO2023/105306

PCT Pub. Date: Jun. 15, 2023

(65) Prior Publication Data

US 2025/0044056 A1 Feb. 6, 2025

(51) Int. Cl.

*F41C 33/00* (2006.01)
*A44B 11/00* (2006.01)
*F41C 23/02* (2006.01)

(52) U.S. Cl.

CPC ..... *F41C 33/002* (2013.01); *A44B 11/005* (2013.01); *F41C 23/02* (2013.01); *F41C 33/001* (2013.01)

(58) Field of Classification Search

CPC ..... F41C 33/002; F41C 33/001; F41C 23/02; A44B 11/005
USPC ..... 224/150
See application file for complete search history.

(56) References Cited

U.S. PATENT DOCUMENTS 745,866 A * 12/1903 Laing ..... F41C 33/002 224/931
919,301 A * 4/1909 Anderson ..... F41C 23/02 224/913
2,536,252 A * 1/1951 Bates ..... F41C 33/003 224/913
2,576,559 A * 11/1951 Bennek ..... F41C 33/003 224/246
2,647,667 A * 8/1953 Brown ..... F41C 33/005 224/913
3,655,106 A * 4/1972 Wojcinski ..... F41C 33/002 D22/108
3,819,094 A * 6/1974 Hyde ..... F41C 33/00 224/625
3,869,074 A * 3/1975 Roach ..... F41C 33/005 224/913
4,751,923 A * 6/1988 Marino ..... A61F 5/3738 224/675

(Continued)

FOREIGN PATENT DOCUMENTS

DE 202015001057 U1 6/2015
WO 2009092359 A1 7/2009

*Primary Examiner* — Peter N Helvey

(57) ABSTRACT

A gun carrying strap system, with a V-shaped belt strap as a chest part having two legs connected at one end, a tip section located in use position fold down behind the neck of a user, and is connected through a length-adjustable hook-and-loop webbing link with an upper extension arranged on the back of the user, the other ends of the legs are connected through links with side extensions of the back part, both legs are in use position connected with buckle ends on the chest of the user, a gunstock holder is designed as a separate basket for the partial receiving a stock of a carried weapon.

8 Claims, 11 Drawing Sheets

(56) References Cited

U.S. PATENT DOCUMENTS

Figure 1:
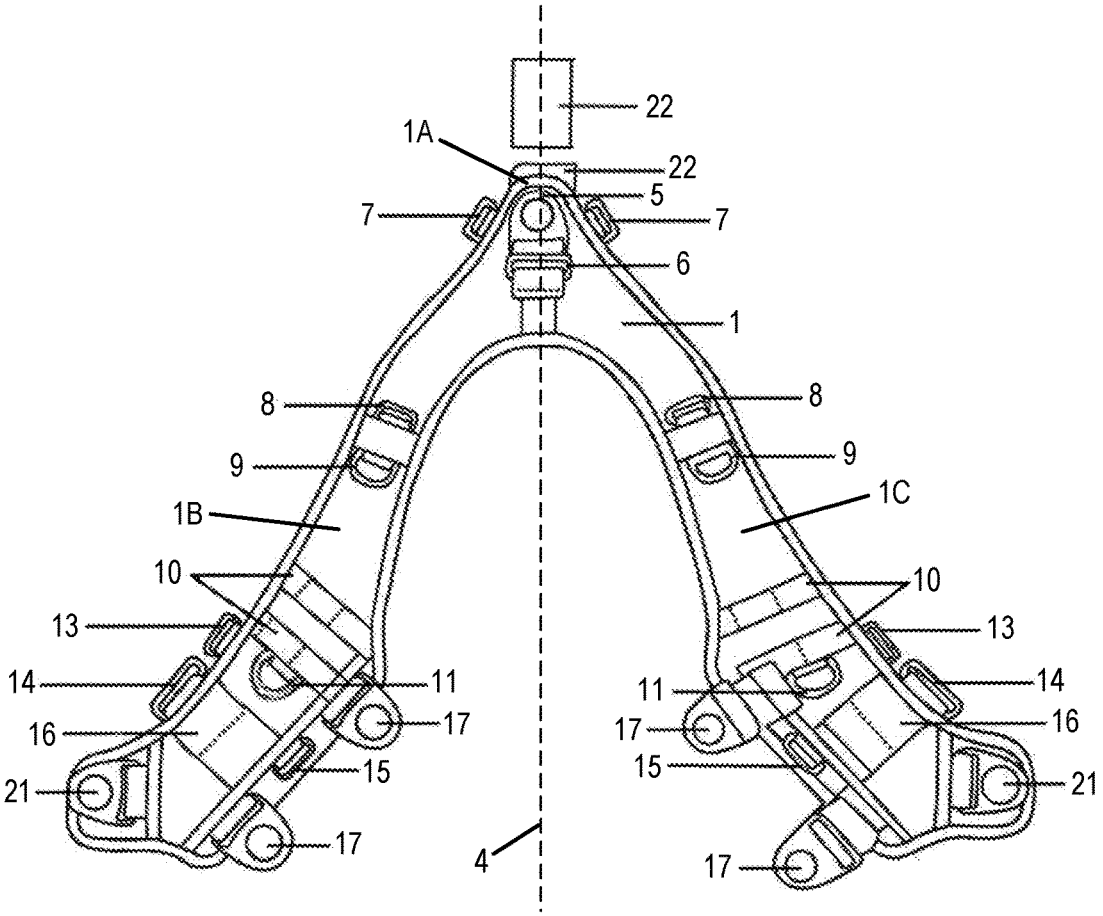

| | | | | | |
|---|---|---|---|---|---|
| 4,819,845 | A * | 4/1989 | Byrd | A63C 11/025 | 224/250 |
| 4,903,875 | A * | 2/1990 | Smart | A63C 11/025 | 224/268 |
| 4,964,553 | A * | 10/1990 | Glynn | F41C 33/003 | 224/913 |
| 5,092,505 | A * | 3/1992 | Olschlager | F41C 23/02 | 224/150 |
| 5,325,618 | A * | 7/1994 | Turner | F41A 17/08 | 224/913 |
| 5,664,721 | A * | 9/1997 | Homeyer | F41C 33/005 | 224/916 |
| 5,669,170 | A * | 9/1997 | Norris | F41C 33/00 | 224/258 |
| 6,152,338 | A * | 11/2000 | Smith | A45F 3/14 | 224/675 |
| 8,814,018 | B1 * | 8/2014 | Mozes | F41B 5/1453 | 224/625 |
| D756,106 | S * | 5/2016 | Reisbeck | D3/222 | |
| 9,587,908 | B2 * | 3/2017 | Bjelde | F41C 33/007 | |
| 10,228,216 | B2 * | 3/2019 | Reeves | F41C 33/007 | |
| 10,989,495 | B2 * | 4/2021 | Baskins | F41C 33/046 | |
| 11,054,213 | B2 * | 7/2021 | Schaub | F41C 23/02 | |
| 2023/0280126 | A1 * | 9/2023 | Swensen | F41C 33/002 | 224/150 |

* cited by examiner

HUNTING VEST SYSTEM

The invention relates to a gun carrying strap system according to the subject matter of claim 1 for carrying a long gun on the upper body. The proposed strap system is designed to carry a gun and equipment used by a user, in this description also referred to as a hunter, i.e. any long gun, mainly a hunting rifle during hunting activities in two preferred carrying modes, firstly for rapid retrieval of the rifle from the haul position and bringing in the firing position for shooting the game, and secondly for carrying the weapon in a further preferred carrying mode opened during hunting breaks.

Currently available gun belts, straps and body straps facilitate the passive carrying of a gun, hereinafter also referred to simply as a rifle, and other equipment on a hunt only partially. This means that bringing the rifle into a firing position requires the hunter to make at least two or more complex hand movements, the duration of which is longer than the time required for the hunter to bring the rifle from the haul position to a firing position to shoot a fast-moving game in time.

EP 2507578 B1 describes a common and commonly used solution whereby the rifle is stored and carried in a box-like container designed for this purpose, which is attached to or integrated into the hunter's backpack. This design obviously cannot allow the hunter to bring the rifle from the haul position to the firing position with sufficient speed and a simple, natural movement.

U.S. Pat. No. 11,054,213 B2 describes an adjustable chest strap to carry a long gun or a crossbow and to release it quickly. The strap comprises a main belt strap supported by the wearer's shoulder, and the opposite ends of the strap are connected to a pocket-like basket that fits against the side of the wearer's waist and holds the stock of the firearm or crossbow. A secondary support strap extends from the main belt strap and can be attached to the forestock of the firearm or crossbow to provide a hands-free support when carried by the wearer. The chest carrying strap had the shortage that the weight of the gun, mostly a rifle, about 3-8 kg (6.6-17.6 lbs) is supported by a small and inadequate muscle group, the narrow webbings of the strap do provide insufficient contact surface, and the supporting body parts may get very fatigued, causing itching, irritation, and pain. Furthermore, a sudden movement of the hunter's body to the left (other) side, a movement common in hunting, may cause a head injury to the hunter. The gunstock is held and supported in the front grip and support for the rifle's muzzle is located in the frontal thigh area, which significantly reduces the hunter's movement range and excludes a crouching position.

US 2022/0042766 A1 describes a hands-free carrying device for a long gun, such as a rifle, where the support plate is supported on the user's chest and the support plate features a gripping device, which is designed to engage and support the weapon in a ready position allowing detachment. At least one of the jaw elements on the gripping device open to the outside is resiliently flexible to receive and retain the gun forestock between the jaw elements. However, the horizontally worn belt strap is inappropriately positioned, passing through the stomach area, over soft tissue, without being supported by bones. This position of the horizontal belt strap significantly restricts the natural movement of the diaphragm, the breathing, particularly in the squatting position, which is a natural basic position for hunting. The rifle carrying method with a carrying tool is not suitable, or even impossible for hunting in environments such as high cornfields or other high bushes in the hunting area. The areas mentioned are considered as essential bird hunting areas. In the case of a gun attached to the belt to the body, the hunter must apply a more complex and time-consuming procedure to bring the rifle into the firing position.

The above summary also states that the existing technical features for carrying a rifle do not allow hunters to carry the rifle safely on their upper body during a break in hunting and to easily retrieve it to resume hunting. Since the currently known technical solutions do not offer a satisfactory solution to retrieve the rifle simply and quickly by a natural hand and body movement from the haul position and to bring it to the firing position, hunters are mostly forced to carry the rifle in the traditional way, either in the hand or shoulder-hung with a gun sling. Carrying the rifle in the hand fatigues the hunter's hands excessively, and the hunter has limited movement opportunities. Carrying a rifle on the shoulder with a gun sling requires the hunter to perform a more complex and prolonged set of movements to bring the rifle in the firing position and to shoot the game, significantly increases the fatigue of the hunter's hand muscles and the whole body, resulting in an increased number of missed shots and/or wounded game, which is not compatible with the ethical code of hunting and environmental requirements.

The object of the present invention is to provide, based on U.S. Pat. No. 11,054,213 B2, a means for carrying a long gun, primarily a rifle, with the avoidance of the above disadvantages. More specifically, the invention aims to create a device that allows the quick and practical retrieval of a long gun, such as a rifle, from the safe carrying position to a firing position. In addition, our invention aims to provide a better way to carry an object for extended periods and to ensure that the weight of the long gun is evenly distributed over the wearer's shoulders.

It is recognized that the above objectives can be easily achieved, if the automatic self-positioning of the stock basket in the vertical mid-plane of the wearer's body in the first, vertical haul position is provided and a quick-release front clamp is arranged in the upper chest area of the strap system, and a second quick-release clamp is provided on the side of the chest area of the strap system opposite to the stock basket, where the position of the first and the second quick-release clamp is free to adapt to the wearer's body dimensions and if the said the second clamp is designed in a manner allowing an opened gun to be clamped and carried in a safe manner.

The formulated task has been solved with a gun-carrying vest system according to the characteristic features of claim 1. Preferred embodiments are described in the dependent claims.

The gun carrying strap system according to the invention is designed to virtually integrate the rifle with the hunter's upper body, allowing for safe and easy rifle carrying, easier movement of the hunter, and the ability to bring the rifle from the haul position to the firing position in less than a second by releasing the clamp.

As the gun carrying strap system distributes the weight of the rifle across the suitable pectoral and dorsal muscle groups of the hunter's upper body, the hunter's fatigue and energy expenditure are considerably reduced. This prevents the hunter from being exhausted after a full day's hunting.

The gun carrying strap system according to the invention allows the hunter to keep the rifle safely on his body during the hunting break, allowing a more efficient shooting of the game with less wounded game, which is the basis of the Code of Ethics for Hunting and of environmental protection.

Unlike known and used solutions, the gun carrying strap system according to the invention allows three different ways to carry the rifle on the hunter's upper body during hunting, without the need to hold the rifle in the hand, and the rifle can be carried in all three carrying positions without constricting the blood circulation in the hunter's arms, because the weapon can be carried statically and dynamically as an integral part of the body, its entire weight being carried by the hunter's upper body, rather than by the hand.

Figure 2:
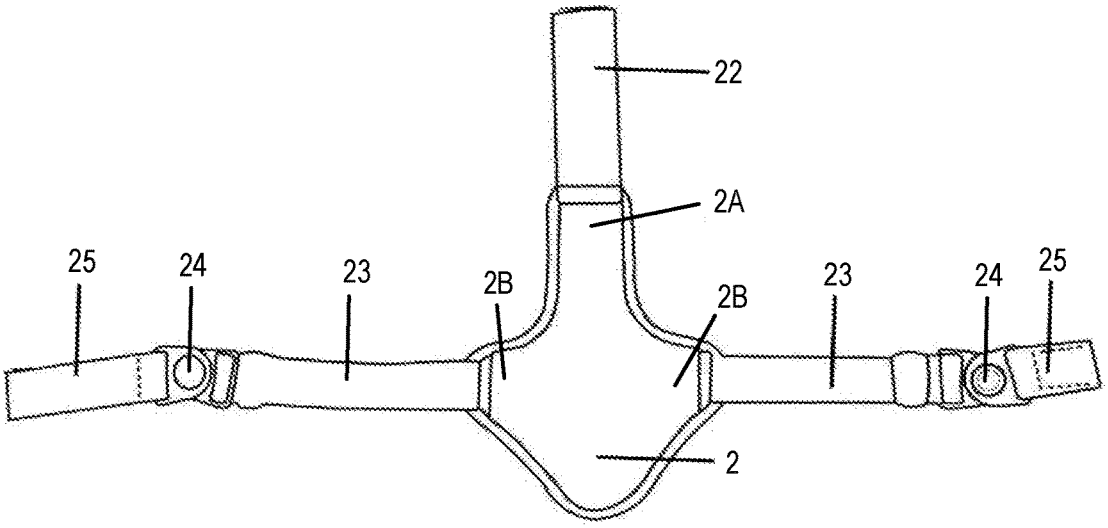
Figure 3:
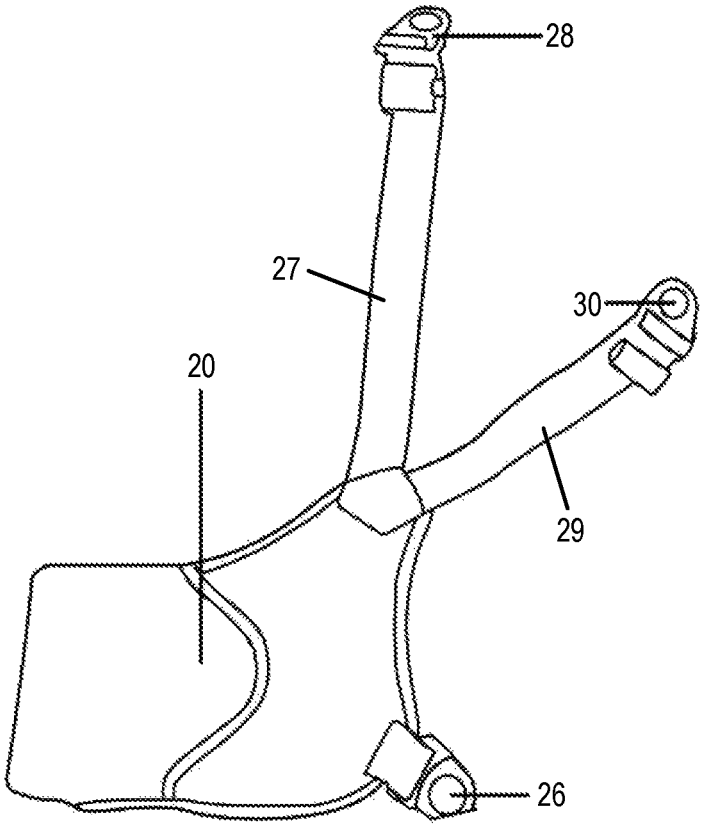
Figure 4:
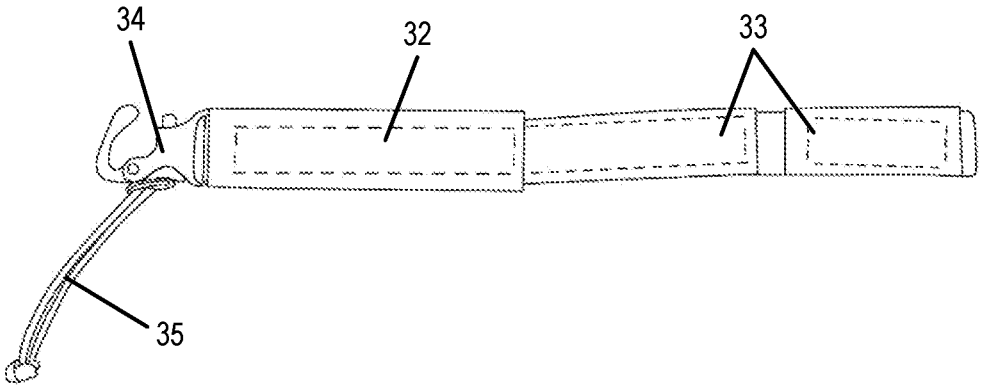
Figure 5:
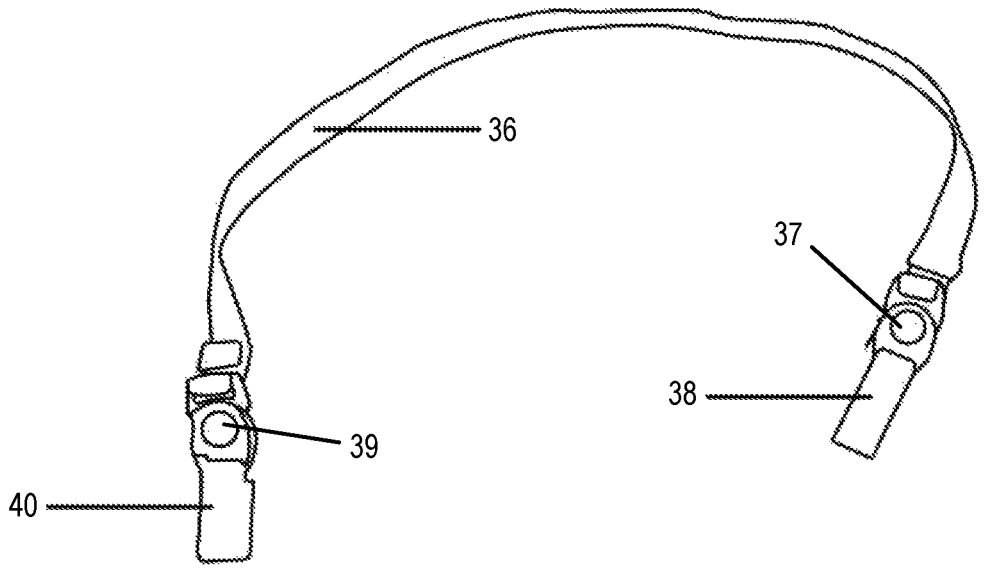
Figure 6:
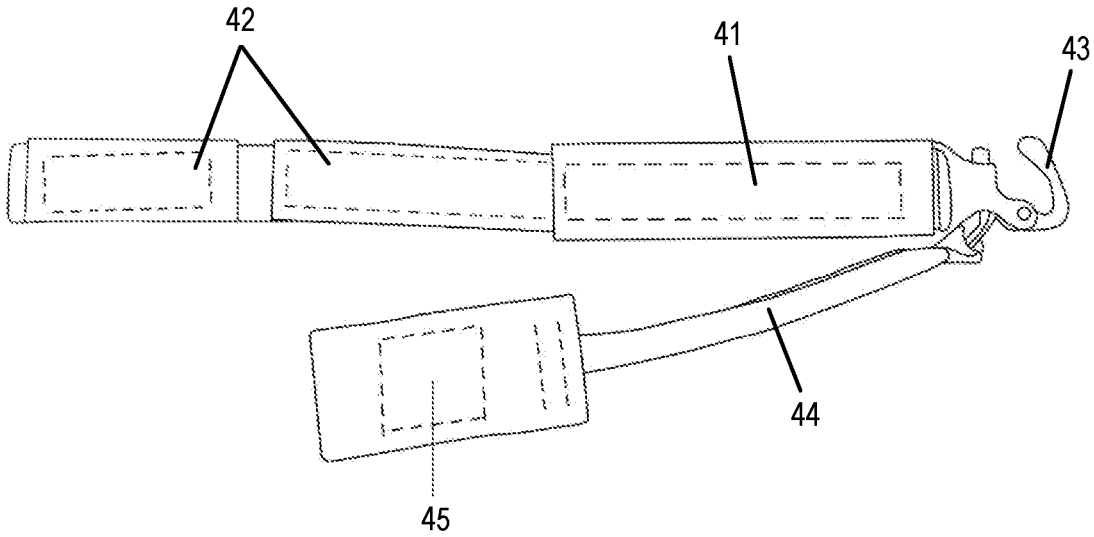
Figure 7:
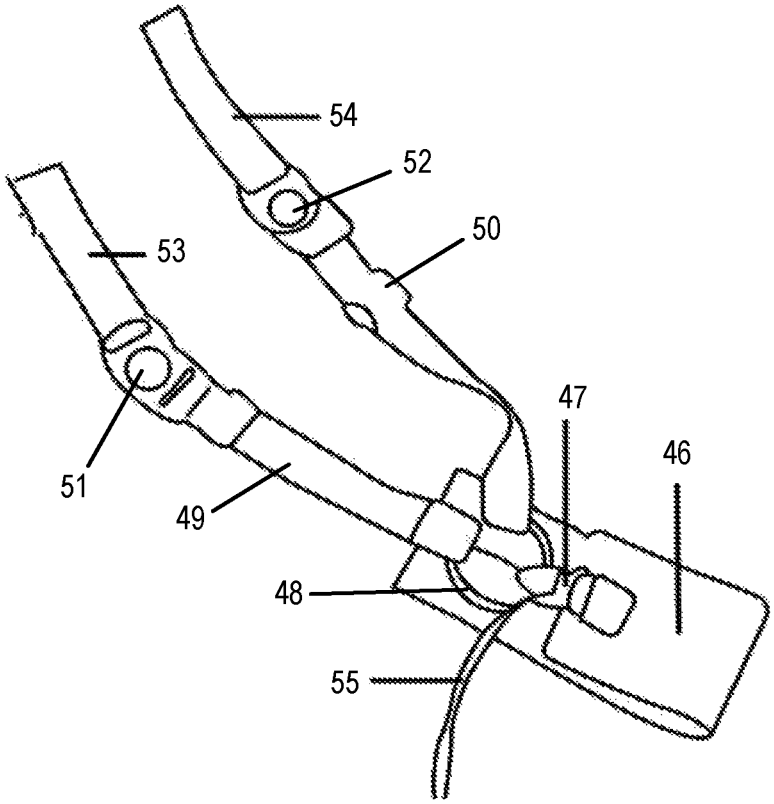
Figure 10:
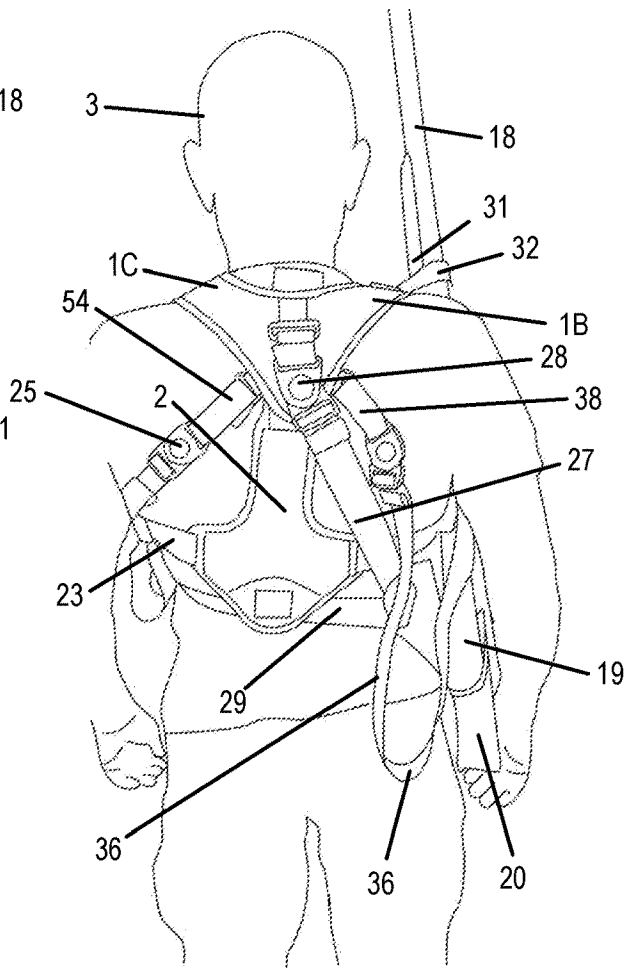
Figure 9:
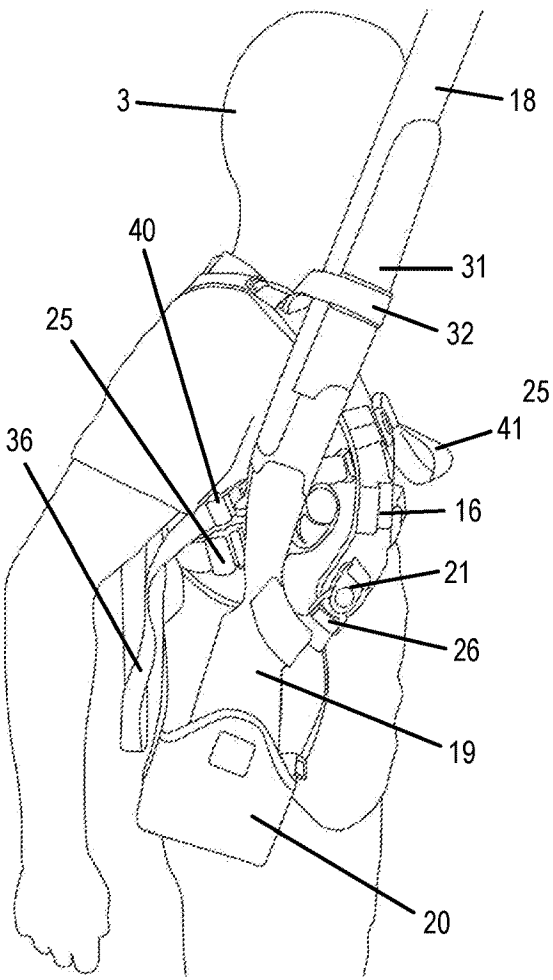
Figure 8:
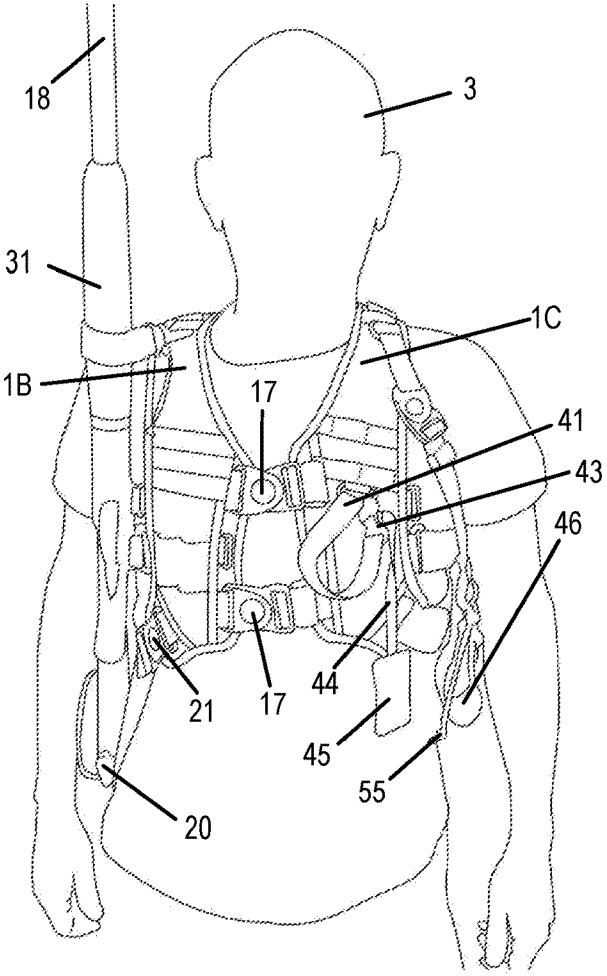
Figure 13:
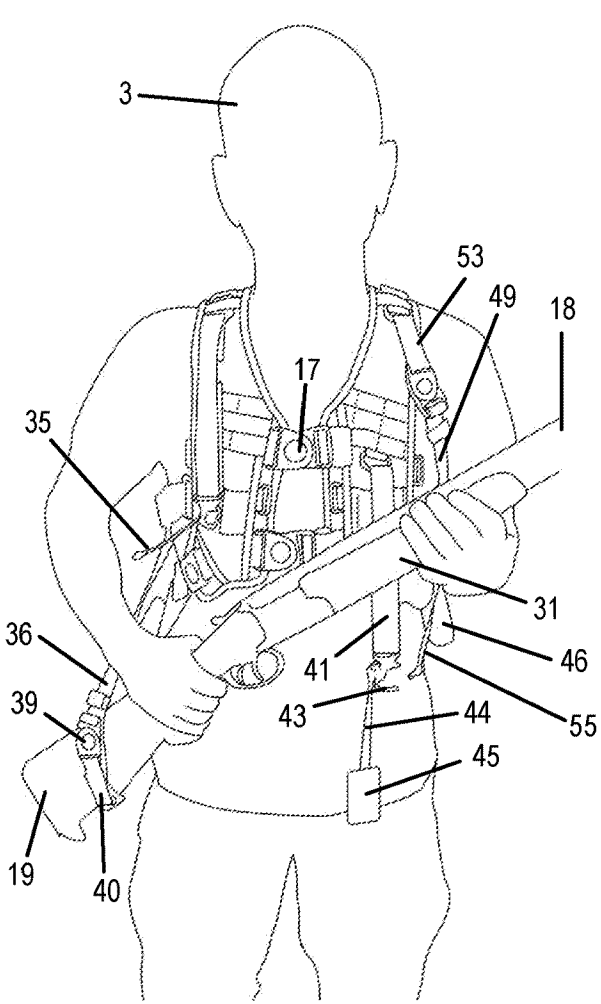
Figure 12:
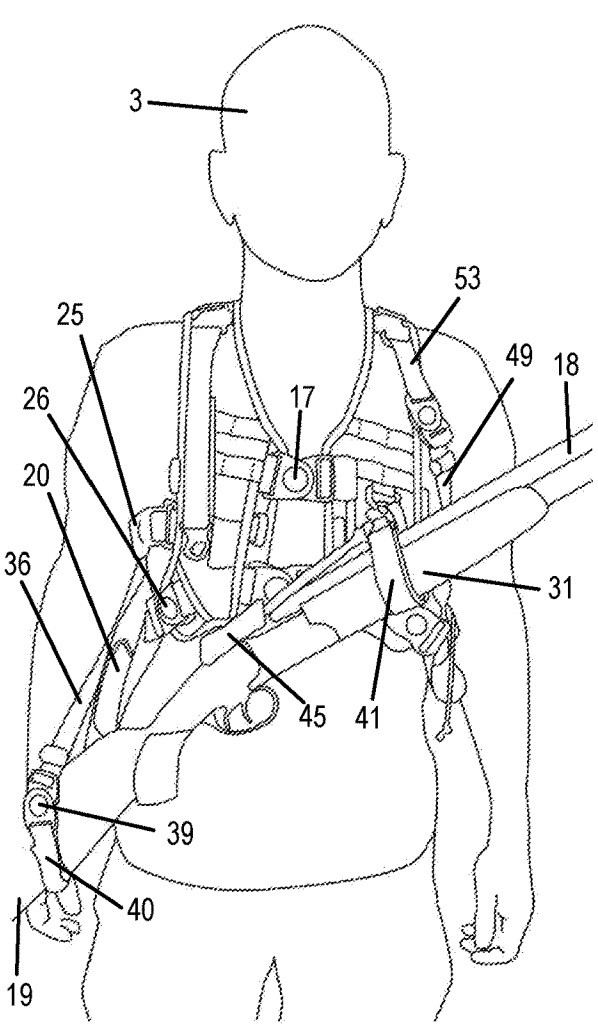
Figure 11:
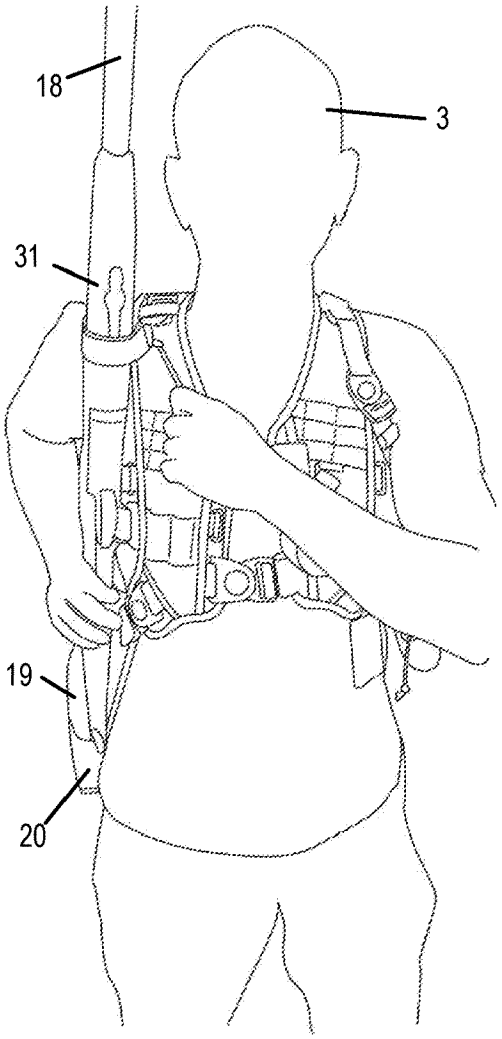
Figures 14, 15, 16:
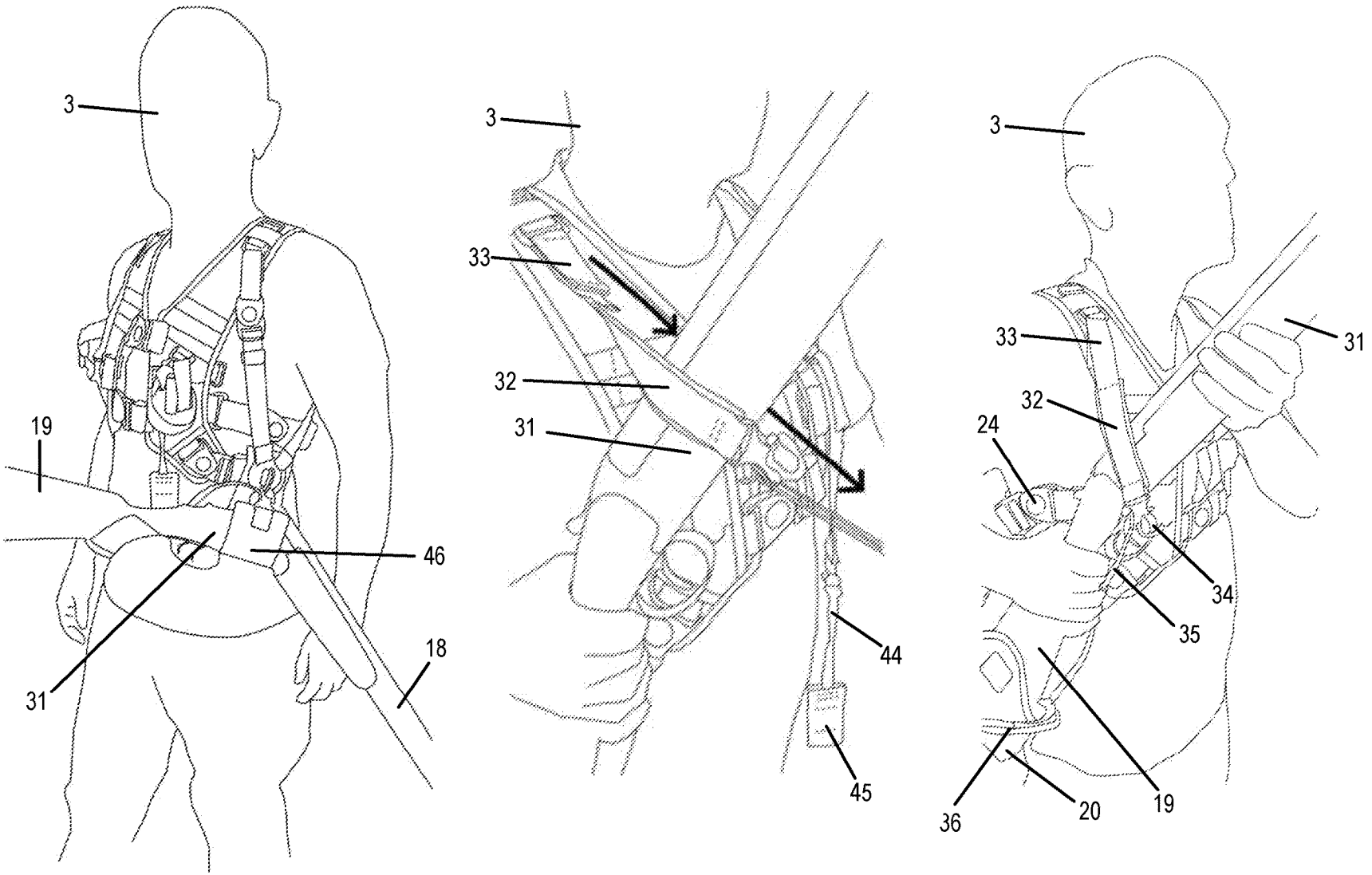
Figure 19:
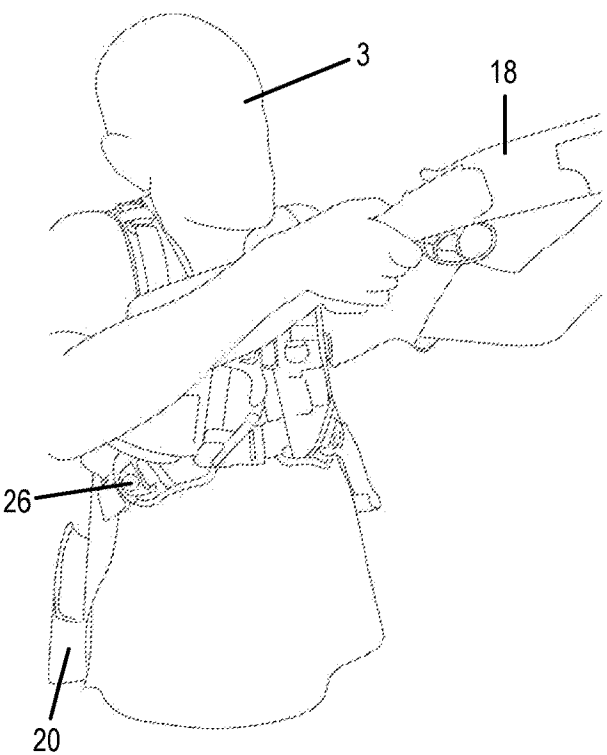
Figure 18:
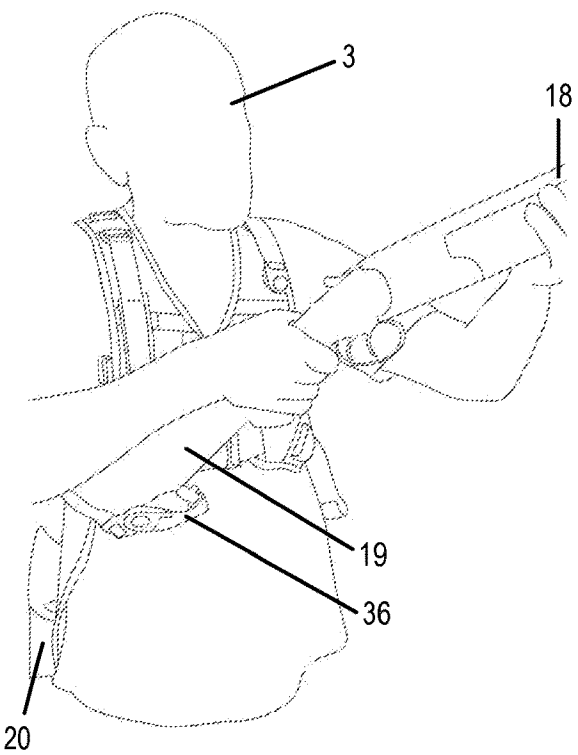
Figure 17:
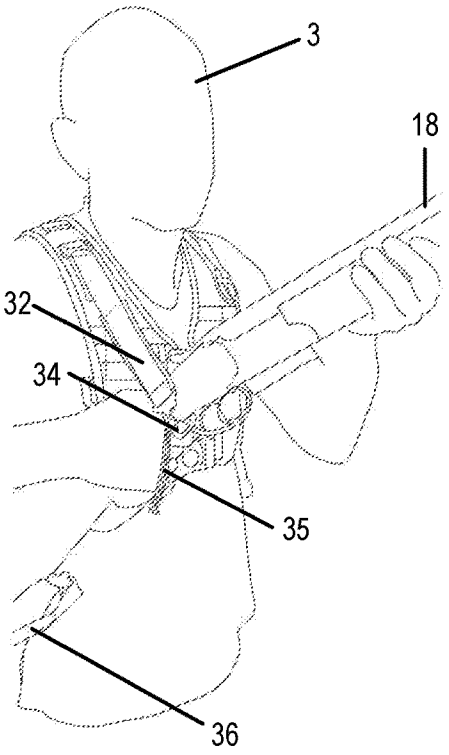
Figure 22:
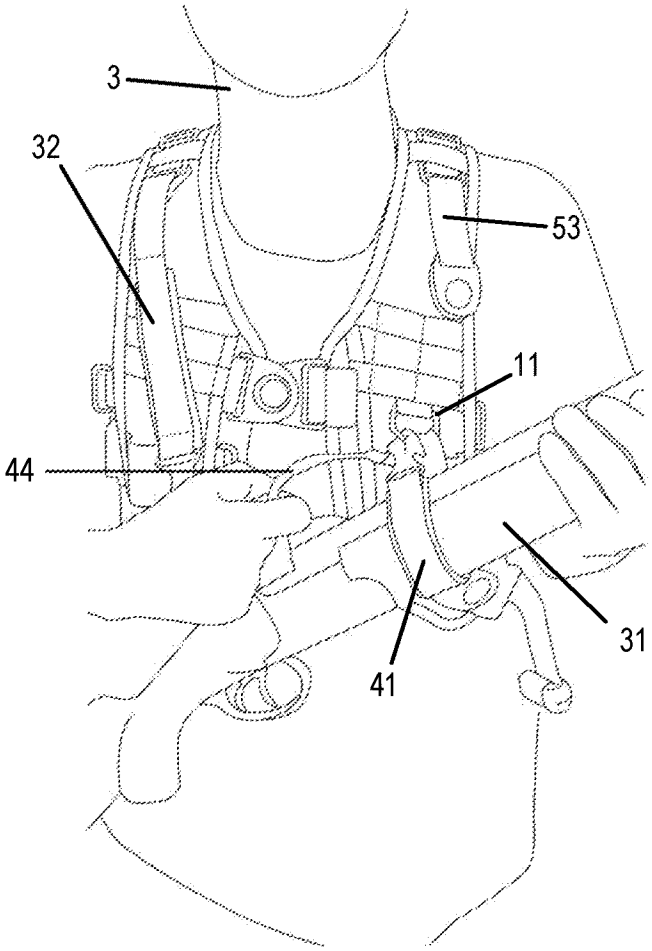
Figure 21:
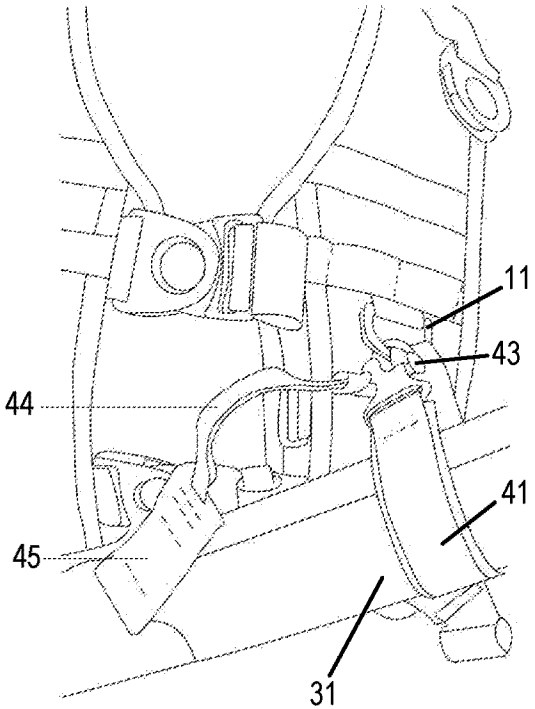
Figure 20:
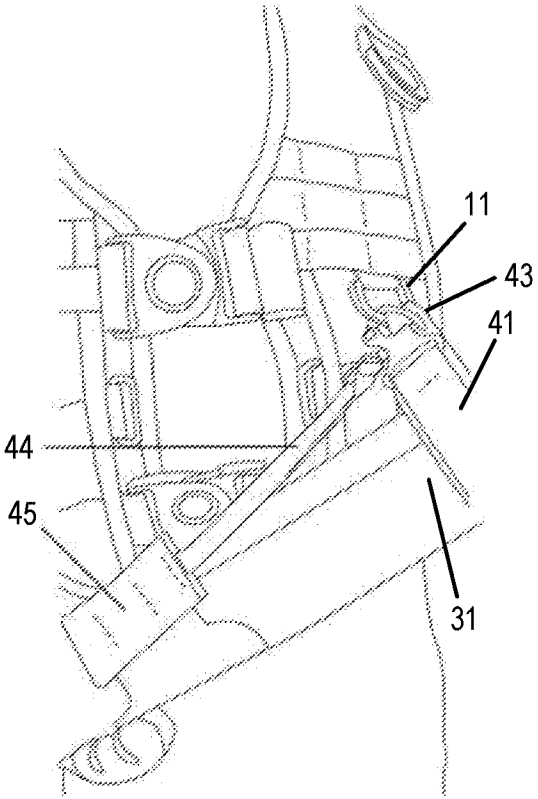
Figure 25:
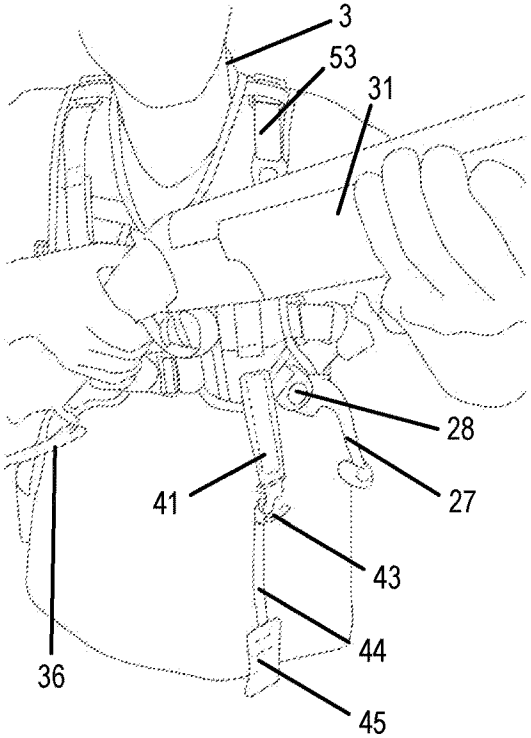
Figure 24:
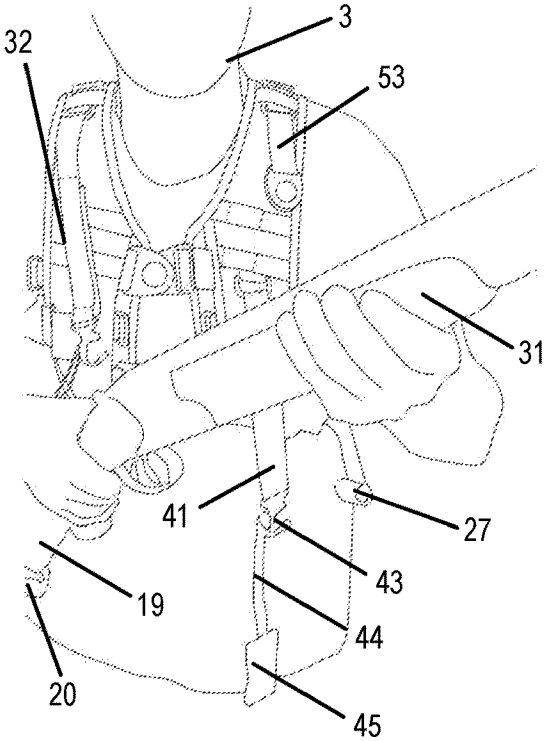
Figure 23:
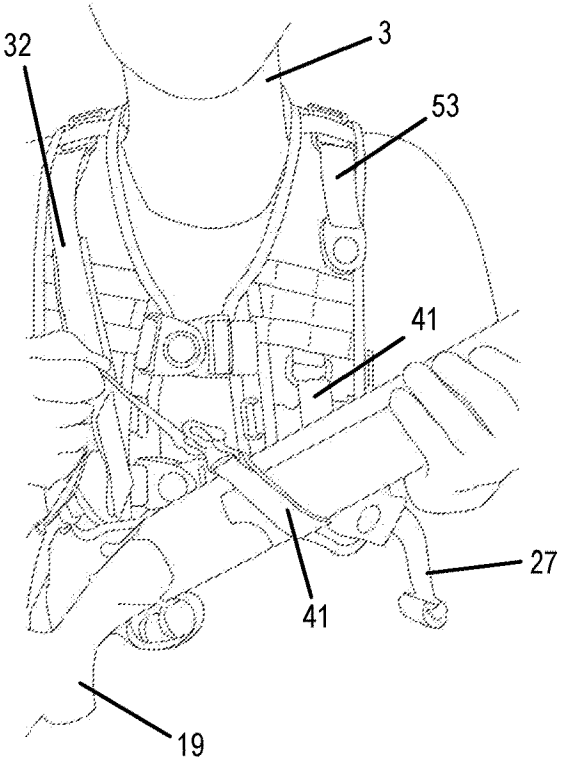
Figure 26:
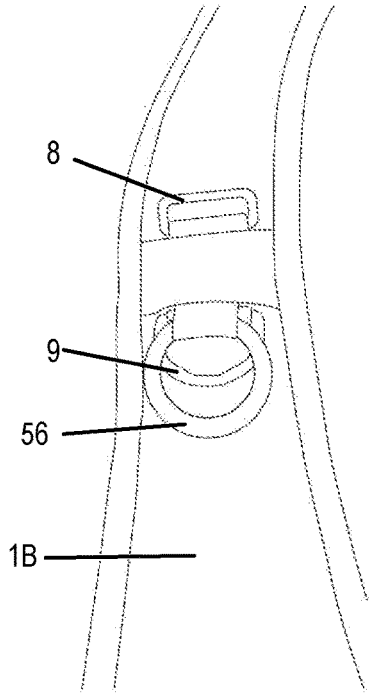
Figure 27:
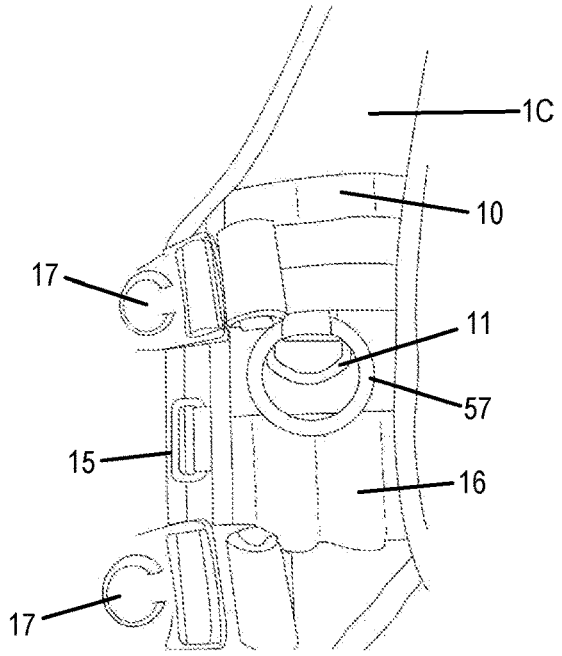
Figure 28:
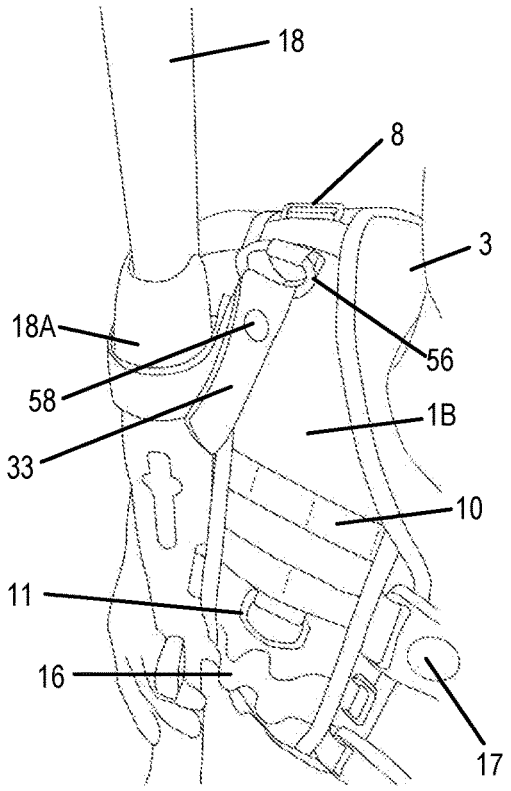
Figure 29:
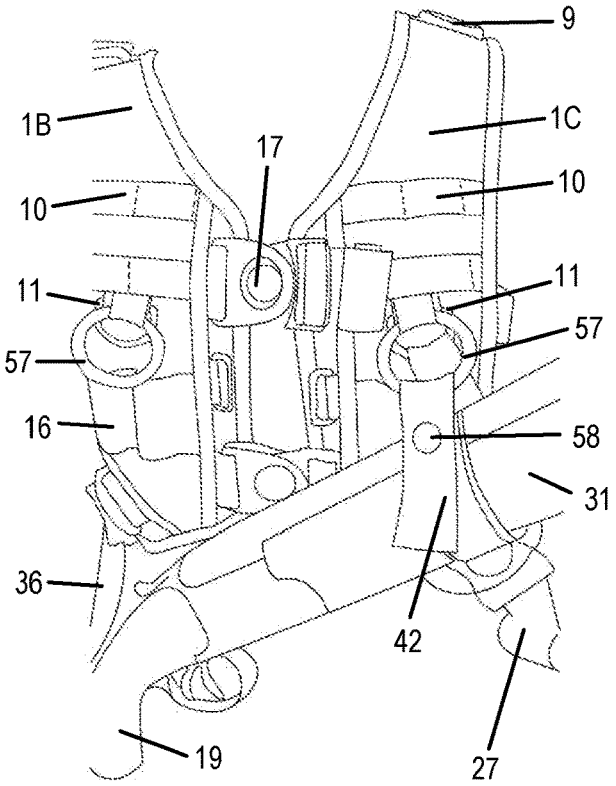

The gun carrying strap system according to the invention is described below in more detail by means of design examples, with reference to the attached drawing, where FIG. 1 is a developed plan view of the chest part of the gun carrying strap system of the invention as a design example, FIG. 2 is a developed plan view of the back part attached to the chest part of the gun carrying strap system shown in FIG. 1, FIG. 3 is a developed plan view of the gun support attached to the chest part of the gun carrying strap system shown in FIG. 1, FIG. 4 is a developed plan view of a possible design of the front clamp to hold the forestock attached to the chest part of the gun carrying strap system shown in FIG. 1, FIG. 5 is a perspective view of the band supporting the rifle in an upright position, attached to the chest part of the gun carrying strap system shown in FIG. 1, FIG. 6 is a perspective view of a possible design of the second front clamp to hold the forestock, attached to the chest part of the gun carrying strap system shown in FIG. 1, FIG. 7 is a perspective view of a further possible design of the second clamp to hold the forestock, attached to the chest part of the gun carrying strap system shown in FIG. 1, FIG. 8 shows the first upright rifle haul carrying mode, using the gun carrying strap system in the presented design, FIG. 9 shows the position as shown in FIG. 8, with the wearer from the side, FIG. 10 shows the position as shown in FIG. 8, with the wearer from behind, FIG. 11 shows the moment of changeover from the haul position to the firing position by releasing the first clamp of the forefoot holder, FIG. 12 shows the rifle, carried hands-free and diagonally over the body, for example, in haul position, in front view, FIG. 13 is the moment of transition from the diagonal haul position over the body as seen in FIG. 12 in the firing position, with the forestock in the hand, after releasing the second forestock clamp, FIG. 14 shows the third way of carrying, i.e., carrying the rifle in an opened state, for example during a break in a hunt, FIG. 15 shows the moment of moving the rifle from the haul position to the firing position after having the first clamp of the forefoot holder as per FIG. 15 released, FIG. 16 shows the moment shown in FIG. 16, with the stock basket offset providing for the required movement, FIGS. 17-19 show further moments of the rifle being moved to the firing position, FIG. 20 shows the position of the second forestock clamp releaser as per FIG. 21 in an idle position, in contact with the metal rifle lock, FIG. 21 shows the arrangement shown in FIG. 20, to ensure the operation of the magnetic release band e.g., in winter, while wearing gloves, FIG. 22 shows the operation of the second forestock clamp releaser as shown in FIG. 20, FIG. 23 shows the second forestock clamp at the moment of releasing the clamp, FIGS. 24 and 25 show the gun held in hand after having the second forestock clamp released, FIG. 26 shows a band fastening solution variant in a larger view, FIG. 27 shows a further band fastening solution in a larger view, FIG. 28 is a detail showing the first haul rifle position, in an enlarged oblique top view, and FIG. 29 shows the rifle, carried hands-free and diagonally over the body, in front view, with a further second clamp design for forestock fixing.

The merely exemplary preferred design of the gun carrying strap system as shown in the Figures comprises two main parts, a chest part 1 and a back part 2.

The chest part 1, as shown in FIG. 1, is a substantially V-shaped belt strap, which is worn over the shoulders of a user 3 carrying the gun carrying strap system when carrying the gun carrying strap system. A tip section 1A of the chest part 1 is, in usage position, behind the neck of the user 3 and connected via a length-adjustable hook-and-loop webbing 22, also known as velcro fastener strap, with an upper extension 2A of the back part 2 arranged on the back of the user 3, shown developed in FIG. 2. To ensure the same use conditions for both right-handed and left-handed users 3, the chest part 1 is symmetrical to a dashed centre line 4 symbolically marked in FIG. 1.

The tip section 1A of the chest part 1 has a buckle end 5 and a webbing loop 6 in the centre line 4 and both sides of the tip section 1A are attached with one webbing loop 7 each. The legs 1B, 1C of the chest part 1, which essentially run upright on the chest of the user 3 in use position, have respective webbing loops 8 in the centre area of the legs 1B, 1C looking toward the tip section 1A and looking toward the other end of the legs 1B, 1C, each one D ring 9 to attach a rifle 18 designated as gun and to mount the hook-and-loop webbings 53, 54 required to adjust the position of the rifle 18.

In the middle area of the straps 1B, 1C, attached to the chest part 1, below the webbing loop 8 and the D ring 9, MOLLE (Modular Lightweight Load-carrying Equipment) compatible fixing segments 10 and D rings 11 are attached. At the opposite end of the legs 1B, 1C of the chest part 1, facing down in the use position, respective outer edges of the legs 1B, 1C have a webbing loop 13 to fix the gun carrying strap 12, as well as the webbing loop 14 to receive the link to attach one of the side extensions 2B to the back part 2 shown in FIG. 2, while inner edges of the legs 1B, 1C have the webbing loop 15 for mounting a drink bag, which is not shown separately. On legs 1B, 1C, at the height of the webbing loops 13, 14, and 15, a rubber fastening band 16 is attached, for example for storing cartridges. To connect the legs 1B, 1C of the chest part 1 in the use position, the lower part of the legs 1B, 1C have the buckle ends 17 on the inner edge of the legs 1B, 1C for the detachable mutual connection. On the bottom part of the legs 1B, 1C, a buckle end 21 is attached for securing a basket 20 to receive and to support a stock 19 of the gun, in this case of the rifle 18. The strap system may also be fitted with additional unspecified mounts, to allow other equipment items normally used in such applications: rucksack, cape, canteen, tools, etc. to be attached in the usual way.

Together with the exemplary chest part 1, the back part 2 constituting the other main part of the gun carrying strap system according to the invention is shown in FIG. 2. The back part 2 consisting of webbing is connected at three locations detachably with the chest part 1 to secure it: the upper extension 2A is connected via a hook-and-loop webbing 22 as a link to the webbing loop 6 on the tip section 1A of the chest part 1. The side extensions 2B to the back part 2 are attached via a webbing 23, a buckle 24 and a hook-and-loop webbing 25 each to the webbing loops 14 on the chest part 1.

FIG. 3 shows an example of the attachment options of the gunstock holder attached to the chest part 1 of the gun carrying strap system, the basket 20 to receive and to hold the stock 19 of the rifle 18 to the chest part 1. The basket 20, facilitating the upright carrying or holding of the rifle 18, is either directly connected through the buckle 26 to the buckle end 21 on the bottom end of the respective leg 1B or 1C or, to provide more free movement to the stock 19 of the rifle 18, connected through a webbing 27 and a buckle end 28 and a webbing 29 and a buckle end 30 to the buckle end 5 and the buckle end 21.

FIG. 4 shows a possible design of the front quick-release clamp attached to the chest part 1 of the gun carrying strap system to fix a forestock 31 of the rifle 18 carried or held in the upright position. In this case, this front clamp is a simple fixing webbing 32, which is fixed in the webbing loop 8 on the respective leg 1B or 1C of the chest part 1, with a hook-and-loop webbing 33 adjusted to the required length and folded back, while the other end is fixed with a quick-release shackle 34 that may be operated with an attached actuator being a release cord 35 in the embodiment shown. The fixing webbing 32 and the hook-and-loop webbing 33 may be also realised with a single hook-and-loop webbing 33. This clamp can also be used as a second quick-release clamp for the locking and quick-release of the forestock 31 of the rifle 18 in a manner understandable for insiders.

FIG. 5 is a perspective view of a fixing webbing 36 supporting the rifle 18 in upright position, attached to the chest part 1. One end of the fixing webbing 36 is connected through a buckle 37 and a hook-and-loop webbing 38 to the webbing loop 7 on the corresponding leg 1B, 1C of the chest part 1, the other end is connected through a buckle 39 and a hook-and-loop webbing 40 to the standard webbing loop on the stock 19 of the rifle 18, not separately shown.

FIG. 6 is a schematic view of another possible design of a second clamp to fix the forestock 31 of the rifle 18, attached to the chest part 1 of the gun carrying strap system. One end of a fixing webbing 41 is connected through a hook-and-loop webbing 42 to the D ring 9 on the corresponding leg 1B, 1C of the chest part 1, the other end has a quick-release shackle 43, and the actuator is a flexible magnetic plate 45 connected with the strap 44, which sticks on the metal lock of the rifle 18, when the gun is carried in a cross position.

FIG. 7 is a further possible design of the second clamp to hold the forestock 31, attached to the chest part 1 of the gun carrying strap system, which can be used to carry an opened gun, when not in use. The forestock 31 of the gun, in this case of the rifle 18 is held by a strap 46, which is connected through a quick-release shackle 47 to a ring 48. Two webbings 49, 50 are attached to the ring 48, which are connected each through buckles 51 and 52, hook-and-loop webbings 53 and 54 to the webbing loops 7 and the D ring 9 on the corresponding leg 1B, 1C of the chest part 1. Also with this design, the quick-release shackle 47 is unlocked by a release cord 55 serving as an actuator.

The gun carrying strap system according to the invention integrates the rifle 18 with the body of the user 3 in a way allowing the rifle 18 to be carried safely and easily, and the user 3 to move in the lightest, most natural way possible, and provides the greatest possible speed for the user 3 to change the rifle 18 from the carrying position to the firing position by releasing the quick-release shackles 34, 43, 47 used as quick-release clamps in only seconds from the first touch of the rifle 18 to the firing position. FIG. 8 shows the first upright rifle haul carrying mode, using the gun carrying system in the presented design of the gun carrying strap system, FIG. 9 shows the same with the wearer in the side view, and FIG. 10 shows the upright position according to FIG. 8, with the wearer in the rear view. FIG. 9 clearly shows that the length of the webbings 27, 29 connecting the basket 20 partly holding the gunstock 19 with the chest part 1 is selected in a way that the basket 20 partly containing the stock 19 of the carried gun is located in this use position below the clamp holding the forestock 31 of the gun, next to the hip of the user 3 of the strap system, viewing the user 3 from the front, further back than the clamp fixing the forestock 31.

This ensures that the gun carrying strap system according to the invention causes significantly less fatigue for the user 3, resulting in less energy consumption because the weight of the rifle 18 is distributed over the body of the user 3, among the most suitable, optimal chest and back muscle groups. This will keep providing the user 3 with more energy and vitality even during an all-day hunting event with numerous changes between carrying positions.

The use of the gun carrying strap system according to the invention allows more efficient shooting of game with a lower rate of injury to the game, which is part of the basic hunting ethics and environmental protection and reduces the number of hunting accidents involving human fatalities as well. This can be seen in FIG. 11, which shows the moment of changeover from the haul position to the firing position, and more precisely the pulling of the release cord 35 to release the front locking device of the forestock 31, i.e., the quick-release shackle 34. FIG. 12 shows the rifle 18, carried hands-free and diagonally over the body of the user 3 in haul position, and the rifle 18 can be immediately held in the hand upon releasing the second clamp fastener of the forestock 31, i.e., the quick-release shackle 43 after the diagonal haul position as shown in FIG. 12.

In addition to the above mentioned upright and diagonal carrying modes of the rifle 18, the gun carrying strap system according to the invention allows a third carrying mode for example during hunting breaks, where the rifle 18 is attached to the body of the user 3 in a manner that the user 3 does not hold the rifle 18, it does not occupy or hinder body parts of the user 3 allowing for full movement freedom, it is stored in a place that is no less safe, thus reducing the number of rifle 18 accidents in shooting situations, as shown in the already mentioned FIG. 14, i.e., the proposed strap system will allow the users 3 to keep the rifle 18 safely opened on their body during hunt breaks.

Based on the above description of the gun carrying strap system according to the invention, it is easy to understand how the rifle 18 can be carried in three different ways relative to the body of the user 3 during hunting, without occupying the hands or arms of the user 3.

Both arms of the user 3 can be moved freely in all 3 carrying positions of the rifle 18 without tension and obstructing the blood supply to the arms, because the full load of the rifle 18 is applied and distributed to the body and torso of the user 3, rather than to the arms and hands.

The design of the strap system ensures that the carried rifle 18 acts as an integral part of the body, both in terms of static and dynamic user experience.

The chest part 1 and back part 2 of the strap system are designed to allow all necessary movements of the body of the user 3, together with the rifle 18 and other equipment, as if they were an integral part of the body of the user 3.

The design presented provides two different positions to carry the rifle 18 on the body of the user 3 allowing a rapid shooting position, the rifle 18 is in both positions ready to be changed in shooting position without wasting time. The two positions include the upright carrying mode and the diagonal carrying mode. In both positions, the rifle 18 is not being used except immediately prior to the action, with the arms and hands remaining completely free until the rifle 18 is used, this moment of moving the rifle 18 from the haul position to the firing position is shown in FIG. 15, while FIG. 16 shows the moment of moving the basket 20 holding the stock 19 of the rifle 18 into the position providing the necessary movement of the stock 19 of the rifle 18.

This allows the rifle 18 to be moved into the firing position without obstruction as shown in FIGS. 17-19.

FIGS. 20 to 25 show another possible design of the gun carrying strap system according to the invention, in which the second clamp for the forestock 31 is not of the same design as the first clamp, although the target is also fulfilled by that design, but this variant makes use of the fact that the lock of the gun, in this case of the rifle 18 attached to the forestock 31 is made of metal, steel and therefore magnetic. To take advantage of this, the quick-release shackle 43 is operated with a magnetic plate 45 as an actuator, rather than with a release cord, through an attached longer strap 44, where, in case of the diagonal carrying mode of the rifle 18, the magnetic plate 45 is stuck on the steel lock of the rifle 18 on the forestock 31 of the rifle 18, as shown in FIG. 20. For allowing the clamp to be operated not only with bare hands but also with gloves on, for example, in winter, the strap 44 is long enough to make a loop alongside the magnetic plate 45 stuck on the gun 18, which can fit the gloved finger of the user 3, as shown in FIG. 21. The clamp is released in the usual way, by gripping the magnetic plate 45, see FIG. 22, and pulling it, see FIG. 23, which releases the quick-release shackle 43 and moves the gun without delay to the firing position, see FIGS. 24 and 25.

In addition to the hook-and-loop solution for attaching the various webbings as shown in the embodiments, a standard D ring and/or O ring design is also possible, such variants are shown in FIGS. 26-29, whereas in FIGS. 26 and 28 the D ring 9 is complemented by an O ring 56 and enables attaching a strap with the known double-ring technique, and in FIGS. 27 and 29 the D ring 11 is complemented by an O ring 57 and enables attaching a strap with the known double-ring technique. FIGS. 28 and 29 also show a snap fastener 58 to ensure the fixed position of the webbings 32, and 41 in the usual way.

In all three of these carrying modes, the rifle 18 is attached to the gun carrying strap system according to the invention, which receives and distributes all static loads and dynamic shocks without the use of the hands of the user 3. All three carry modes and positions allow for significantly easier movement in the environment of use and the weight of the rifle 18 is less noticeable.

The carrying positions provided by the gun carrying strap system integrate the rifle 18 into the natural movement paths of the upper body of the user 3, allowing the rifle 18 to be easily and quickly changed from the carrying position to the firing position with a natural movement, without the need to specifically practice this movement, because the movement is intuitive and known to the person handling the rifle 18. By using the strap system, the total energy consumption of the user 3 is significantly reduced compared to the traditional carrying of the rifle 18, the hands of the user 3 will not be fatigued, and the efficiency/effectiveness of the shot is significantly increased.

During a break in the hunt, the gun must be securely fastened to the body of the user 3 in accordance with the regulations. The strap system according to the invention facilitates the fulfilment of this requirement by using it as a harness for the rifle 18.

The design of the gun carrying strap system, with a sufficient range of sizes and individual adjustment options for the body of each user 3 allows for an ideal fit and support on the body of the user 3, minimising the strain on the body while maximising freedom of movement, without hindering or restricting the user 3 in any necessary body movement such as stooping, stealth approach, squatting and the like. The compact design ensures a high level of safety and comfort for the user 3 during use, and hunting, without distractions or any unwanted movement. The materials used for the manufacturing of the strap system ensure that the positive characteristics and functions of the strap system are maintained throughout the entire period of use and that it will perform its function on any type of clothing in any climate. The strap system is lightweight, weighing only 850-990 g (i.e. 1,874-2,183 lbs), and has a small volume.

The material of the gun carrying strap system may be reasonably and preferably a material used in the field of such straps, hiking equipment, even with breathable perforations, which, in addition to providing adequate mechanical strength, tear resistance and water resistance provides for ventilation; therefore, the wearing of the strap system does not restrict the user 3.

LIST OF USED REFERENCES SIGNS

1 chest part
1A tip section
1B, 1C leg
2 back part
2A, 2B extension
3 user
4 centre line
5 buckle end
6 webbing loop
7 webbing loop
8 webbing loop
9 D ring
10 fixing segment
11 D ring
12 gun carrying strap
13 webbing loop
14 webbing loop
15 webbing loop
16 fastening band
17 buckle end
18 rifle
19 stock
20 basket
21 buckle end
22 hook-and-loop webbing
23 webbing
24 buckle
25 hook-and-loop webbing
26 buckle
27 webbing
28 buckle end
29 webbing
30 buckle end
31 forestock
32 fixing webbing
33 hook-and-loop webbing

34 quick-release shackle
35 release cord
36 fixing webbing
37 buckle
38 hook-and-loop webbing
39 buckle
40 hook-and-loop webbing
41 fixing webbing
42 hook-and-loop webbing
43 quick-release shackle
44 strap
45 magnetic plate
46 strap
47 quick-release shackle
48 ring
49, 50 webbing
51,52 buckle
53, 54 hook-and-loop webbing
55 release cord
56 O ring
57 O ring
58 snap fastener

The invention claimed is:

1. A gun carrying strap system, comprising
a chest part (1) made of belt webbing,
a back part (2) made of belt webbing,
where the chest part (1) and the back part (2) are releasably connected,
a gunstock holder connected to the chest part (1),
a forestock (31) fastening means connected to the chest part (1), where the fastening means is designed as a quick-release clamp, characterised in that the chest part (1) is formed as a V-shaped belt strap comprising two legs (1B, 1C) connected to each other at one end, where a tip section (1A) of the chest part (1) is folded down behind a neck region of a user (3) wearing the gun carrying strap system in use position, and is connected through a length-adjustable hook-and-loop webbing link (22) to the upper extension (2A) of the back part (2) arranged on the back of the user (3) wearing the gun carrying strap system, the other ends of each of the two legs (1B, 1C) of the V-shaped belt strap are connected through each one length-adjustable link consisting of a webbing (23), a buckle (24) and a hook-and-loop webbing (25) to both side extensions (2B, 2C) of the back part (2) arranged on the user (3) wearing the strap system, the two legs (1B, 1C) of the V-shaped belt strap are equipped with buckles (17) on the neighbouring inner edges of the legs (1B, 1C) to connect both legs (1B, 1C) of the V-shaped belt strap in a use position with a spacer detachably on the chest of the user (3) wearing the strap system, and the legs (1B, 1C) of the V-shaped belt strap of the chest part (1) are in use position connected with each other detachably using the buckles (17) attached to inner edges of the legs (1B, 1C), the gunstock holder is designed as a separate basket (20) for receiving partly a stock (19) of the carried gun, which is connected through a buckle end (26) with a buckle (21) on outer edges of the legs (1B, 1C) near the end of both legs (1B, 1C) of the V-shaped belt strap, as well as through webbings (27, 29) and buckles (28, 30) with the tip section (1A) of the V-shaped belt strap through a buckle end (5) provided there, the gun carrying strap system comprises as a clamp to fix the forestock (31) a length-adjustable clamp with adjustable detachable fixing on one leg (1B, 1C) of the V-shaped belt strap in the front shoulder area of the user (3) in the use position of the strap system on the one hand, and, on the other hand, a length-adjustable clamp with detachable fixing on the other leg (1C, 1B) of the V-shaped belt strap near the chest of the user (3) wearing the strap system in a use position, the length of the webbing (27, 29) connecting the basket (20) holding the gunstock (19) to the chest part (1) is selected in a manner that the separate basket (20), which partially holds the stock of the carried gun (19), is positioned in use position below the gun forestock clamp (31), next to the hip of the user (3) wearing the strap system, viewing the user (3) from the front, further back than the clamp fixing the forestock (31).

2. The gun carrying strap system according to claim 1, characterised in that the quick-release clamp for facilitating the upright gun carrying, fixed detachably in the use position of the sling system on the one leg (1B, 1C) of the V-shaped belt strap in the front shoulder area of the user (3) wearing the strap system comprises at least on a part of its length a hook-and-loop webbing (33), which is fixed in a webbing loop (8) on the corresponding leg (1B, 1C) of the chest part (1), and a second end of the quick-release clamp is equipped with a quick-release shackle (34), which is in operational connection with an attached release cord (35) used as an actuator.

3. The gun carrying strap system according to claim 1, characterised in that the clamp for facilitating the gun carrying diagonally on the chest of the user (3), fixed detachably in the use position of the sling system on the other leg (1C, 1B) of the V-shaped belt strap in the chest area of the user (3) wearing the strap system comprises at least on a part of its length a hook-and-loop webbing (33), which is fixed in a D ring (11) on the corresponding leg (1B, 1C) of the chest part (1), and a second end of the quick-release clamp is equipped with a quick-release shackle (34), which is in operational connection with an attached release cord (35) used as an actuator.

4. The gun carrying strap system according to claim 3, characterised in that the actuator attached to the quick-release shackle (34) for facilitating the gun carrying diagonally on the chest of the user (3), fixed detachably in the use position of the sling system on the other leg (1B, 1C) of the V-shaped belt strap in the chest area of the user (3) wearing the strap system is a magnetic plate (45) sticking detachably to the metal gun lock, and connected through a belt (44) to the quick-release shackle (43).

5. A gun carrying strap system according to claim 1, characterised in that the legs (1B, 1C) of the V-shaped belt strap are equipped with MOLLE compatible attachment segments (10).

6. A gun carrying strap system according to claim 1, characterised in that the legs (1B, 1C) of the V-shaped belt strap are equipped with elastic attachment webbings (16).

7. A gun carrying strap system according to claim 1, characterised in that it comprises a webbing (36) attached with one end to the webbing loop (7) on the edge of the belt webbing at the tip section (1A) of the V-shaped belt strap and with the other end to the gunstock (19).

8. A gun carrying strap system according to claim 1, characterised in that the V-shaped belt strap with the components fixed on the legs (1B, 1C) is designed symmetrically to an imaginary vertical centre line (4) allowing both right-handed and left-handed gun handling.

* * * * *